US007854142B2

(12) United States Patent
Hatano et al.

(10) Patent No.: US 7,854,142 B2
(45) Date of Patent: Dec. 21, 2010

(54) DUAL AIR CONDITIONER SYSTEM SHARED CAPACITORS

(75) Inventors: Koji Hatano, Shiga (JP); Hideyuki Kanzaki, Shiga (JP); Yoshihito Yamada, Shiga (JP)

(73) Assignee: Panasonic Corporation, Osaka (JP)

( * ) Notice: Subject to any disclaimer, the term of this patent is extended or adjusted under 35 U.S.C. 154(b) by 265 days.

(21) Appl. No.: 11/743,321

(22) Filed: May 2, 2007

(65) Prior Publication Data

US 2007/0283707 A1 Dec. 13, 2007

(30) Foreign Application Priority Data

May 11, 2006 (JP) ..... 2006-132174

(51) Int. Cl.
*F25B 1/10* (2006.01)

(52) U.S. Cl. ..... 62/510; 62/228.1; 62/228.5; 417/5; 417/7; 417/8; 417/411; 318/53; 318/748; 318/789; 318/794; 318/795

(58) Field of Classification Search ..... 62/510, 62/228.1, 228.5; 417/5, 7, 8, 411; 318/43, 318/53, 748, 789, 794, 795
See application file for complete search history.

(56) References Cited

U.S. PATENT DOCUMENTS

| | | | | |
|---|---|---|---|---|
| 5,247,236 | A * | 9/1993 | Schroeder | 318/794 |
| 6,844,698 | B1 * | 1/2005 | Kwon et al. | 318/778 |
| 2005/0160761 | A1 * | 7/2005 | Taras et al. | 62/510 |
| 2005/0172663 | A1 * | 8/2005 | Dobmeier et al. | 62/510 |

FOREIGN PATENT DOCUMENTS

JP 10-019397 1/1998

* cited by examiner

*Primary Examiner*—Frantz F Jules
*Assistant Examiner*—Justin Loffredo
(74) *Attorney, Agent, or Firm*—RatnerPrestia

(57) ABSTRACT

An air conditioner having two compressors enables, when one compressor is started, the phase advance capacitor for the other compressor to be temporarily separated and used in parallel with the phase advance capacitor for the one compressor. These compressors can have an increased starting torque without using a starting capacitor.

2 Claims, 4 Drawing Sheets

DUAL AIR CONDITIONER SYSTEM SHARED CAPACITORS

BACKGROUND OF THE INVENTION

1. Field of the Invention

The present invention relates to an air conditioner having two compressors.

2. Background Art

Conventionally, in an air conditioner having two compressors, each compressor has a phase advance capacitor and a starting capacitor, which increases the starting torque to start the compressor. After a compressor is started, the starting capacitor is separated from the circuit by a relay which detects the auxiliary coil current drawn by the compressor motor. One such conventional air conditioner is disclosed in Japanese Patent Unexamined Publication No. H10-019397.

The conventional technique, however, has the following problems.

FIG. 4 is an electrical circuit diagram of a conventional air conditioner. Of two compressors, first compressor 1 includes main coil 2 and auxiliary coil 3. Auxiliary coil 3 is connected to phase advance capacitor 4, and phase advance capacitor 4 is connected in parallel with starting capacitor 5 via cutout relay 6. The contact of cutout relay 6 is closed when cutout relay coil 7 is not supplied with current and is open when cutout relay coil 7 is supplied with current. Cutout relay coil 7 is connected in parallel with auxiliary coil 3.

Before first compressor 1 is started, auxiliary coil 3 is not supplied with current and hence cutout relay coil 7 is not supplied with current either. Therefore, the contact of cutout relay 6 is in a closed position. Phase advance capacitor 4 and starting capacitor 5 are thus connected in parallel with each other so as to increase the starting torque of first compressor 1.

As soon as first compressor 1 is started, auxiliary coil 3 and cutout relay coil 7 are supplied with current at the same time. As a result, the contact of cutout relay 6 is opened, thereby separating starting capacitor 5 from the circuit. The other compressor, second compressor 8, has the same structure as first compressor 1. First compressor 1 and second compressor 8 are connected in parallel with each other.

As described above, starting capacitor 5 is provided in the respective compressors so as to contribute to an increase in the starting torque. Conventionally, however, each compressor is required to have its own starting capacitor 5 although starting capacitor 5 is not used except when the compressor is started. The provision of starting capacitor 5 makes it difficult to make the system inexpensive.

SUMMARY OF THE INVENTION

In the air conditioner according to the present invention having two compressors, when a first compressor is started, the phase advance capacitor for a second compressor is temporarily connected in parallel with the phase advance capacitor for the first compressor. And, when the second compressor is started, the phase advance capacitor for the first compressor is temporarily connected in parallel with the phase advance capacitor for the second compressor. This structure increases the starting torque of each of the first and second compressors without providing a starting capacitor in the first and second compressors. As a result, the system can be constructed inexpensively.

DETAILED DESCRIPTION OF THE INVENTION

The air conditioner according to the present invention having two compressors enables, when one compressor is started, the phase advance capacitor for the other compressor to be temporarily connected in parallel with the phase advance capacitor for the one compressor.

Embodiments of the present invention are described as follows with reference to drawings. Note that the present invention is not limited to these embodiments.

First Embodiment

Figure 1:
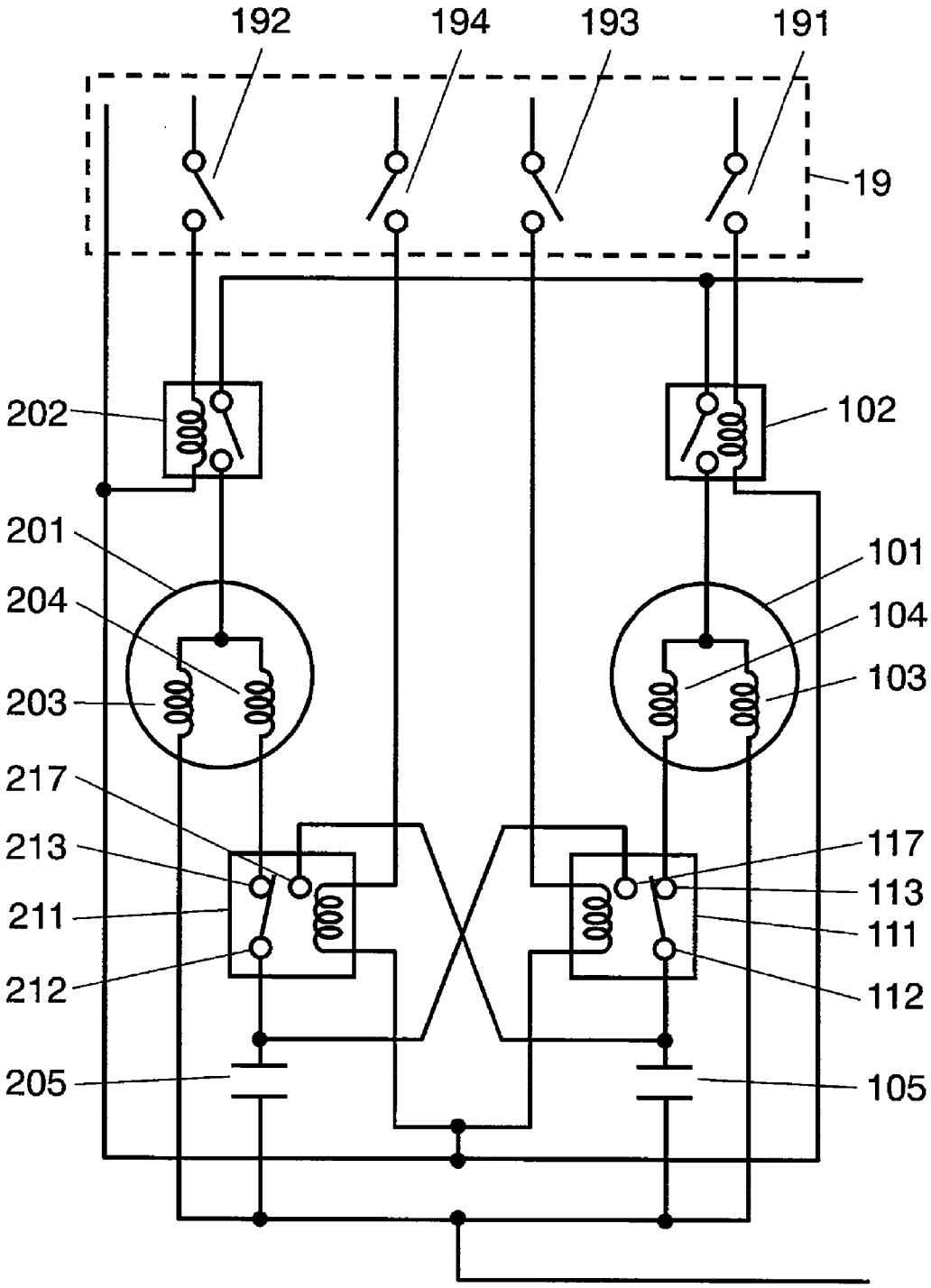
FIG. 1 is an electrical circuit diagram of an air conditioner according to a first embodiment of the present invention.

FIG. 1 is an electrical circuit diagram of an air conditioner according to a first embodiment of the present invention. The air conditioner includes two compressors: first compressor 101 and second compressor 201.

With reference to FIG. 1, the structure of the air conditioner according to the first embodiment of the present invention is described as follows.

Between auxiliary coil 104 of first compressor 101 and phase advance capacitor 105 (first phase advance capacitor) is provided switching relay 111 (first switching relay) which switches between two contacts. Common terminal 112 of switching relay 111 is connected to phase advance capacitor 105 for first compressor 101. Terminal 113, which is closed when the relay coil is not supplied with current, is connected to auxiliary coil 104 of first compressor 101. Terminal 117, which is closed when the relay coil is supplied with current, is connected to the wiring that connects auxiliary coil 204 of second compressor 201 and phase advance capacitor 205 (second phase advance capacitor). In the same manner, between auxiliary coil 204 of second compressor 201 and phase advance capacitor 205 is provided switching relay 211 (second switching relay) which switches between two contacts. Common terminal 212 of switching relay 211 is connected to phase advance capacitor 205 for second compressor 201. Terminal 213, which is closed when the relay coil is not supplied with current, is connected to auxiliary coil 204 of second compressor 201. Terminal 217, which is closed when the relay coil is supplied with current, is connected to the wiring that connects auxiliary coil 104 of first compressor 101 and phase advance capacitor 105. Switching relays 111 and 211 operate under the direction of controller 19.

In the air conditioner of the present embodiment, when first compressor 101 is started, phase advance capacitor 205 for second compressor 201 can be temporarily connected in parallel with phase advance capacitor 105 for first compressor 101. On the contrary, when second compressor 201 is started, phase advance capacitor 105 for first compressor 101 can be temporarily connected in parallel with phase advance capacitor 205 for second compressor 201. This structure eliminates the need to provide a starting capacitor for either of first and second compressors 101 and 201 so as to increase the starting torque of each of first and second compressors 101 and 201, thereby making the system inexpensive.

The air conditioner having the aforementioned structure is described in more detail as follows.

First compressor 101 is connected to power relay 102 (first power relay), which connects or disconnects an AC power supply. First compressor 101 includes a motor having two coils: main coil 103 and auxiliary coil 104. Auxiliary coil 104 is connected to phase advance capacitor 105.

In the same manner, second compressor 201 is connected to power relay 202 (second power relay), which connects or disconnects the AC power supply. Second compressor 201 includes a motor having two coils: main coil 203 and auxiliary coil 204. Auxiliary coil 204 is connected to phase advance capacitor 205. First compressor 101 and second compressor 201 are connected in parallel with the AC power supply.

Between auxiliary coil 104 of first compressor 101 and phase advance capacitor 105 is provided switching relay 111 which switches between two contacts. Common terminal 112 of switching relay 111 is connected to phase advance capacitor 105. Terminal 113, which is closed when the relay coil of switching relay 111 is not supplied with current, is connected to auxiliary coil 104.

Second compressor 201 has the same structure as first compressor 101. Between auxiliary coil 204 and phase advance capacitor 205 is provided switching relay 211, which switches between two contacts. Common terminal 212 of switching relay 211 is connected to phase advance capacitor 205. Terminal 213, which is closed when the relay coil of switching relay 211 is not supplied with current, is connected to auxiliary coil 204.

Terminal 117, which is closed when the relay coil of switching relay 111 is supplied with current, is connected to the wiring that connects common terminal 212 and phase advance capacitor 205. In the same manner, terminal 217, which is closed when the relay coil of switching relay 211 is supplied with current, is connected to the wiring that connects common terminal 112 and phase advance capacitor 105.

Controller 19 includes first compressor operation switch 191, second compressor operation switch 192, first compressor selector switch 193, and second compressor selector switch 194. First compressor operation switch 191 energizes power relay 102, and second compressor operation switch 192 energizes power relay 202. First compressor selector switch 193 energizes switching relay 111, and second compressor selector switch 194 energizes switching relay 211.

First compressor 101 operates when first compressor operation switch 191 in controller 19 closes the contact of power relay 102.

As soon as first compressor 101 is started, controller 19 turns on second compressor selector switch 194 so as to connect common terminal 212 of switching relay 211 to terminal 217, which is closed when the relay coil is supplied with current.

Consequently, phase advance capacitor 205 is separated from auxiliary coil 204 of second compressor 201 and connected to auxiliary coil 104 of first compressor 101 in parallel with phase advance capacitor 105.

Second compressor selector switch 194, which is turned on at the same time as first compressor operation switch 191, is kept in the on state for as short as two seconds and then turned off. When second compressor selector switch 194 is turned off, common terminal 212 of switching relay 211 is connected to terminal 213, which is closed when the relay coil is not supplied with current. As a result, phase advance capacitor 205 is again connected to auxiliary coil 204 of second compressor 201.

Through these operations, the capacity of phase advance capacitor 205 is added to the capacity of phase advance capacitor 105 when first compressor 101 is started. This increases the starting torque of first compressor 101, thereby facilitating the start-up of first compressor 101. In the case where first compressor 101 is started when second compressor 201 is in operation, phase advance capacitor 205 is temporarily separated from second compressor 201. However, second compressor 201 has only a slight decrease in torque during the operation, and therefore the temporary separation of phase advance capacitor 205 does not interrupt the operation.

On the contrary, when second compressor 201 is started, phase advance capacitor 105 is temporarily separated from first compressor 101 and connected to auxiliary coil 204 in parallel with phase advance capacitor 205. As a result, second compressor 201 has an increased starting torque.

Second Embodiment

Figure 2:
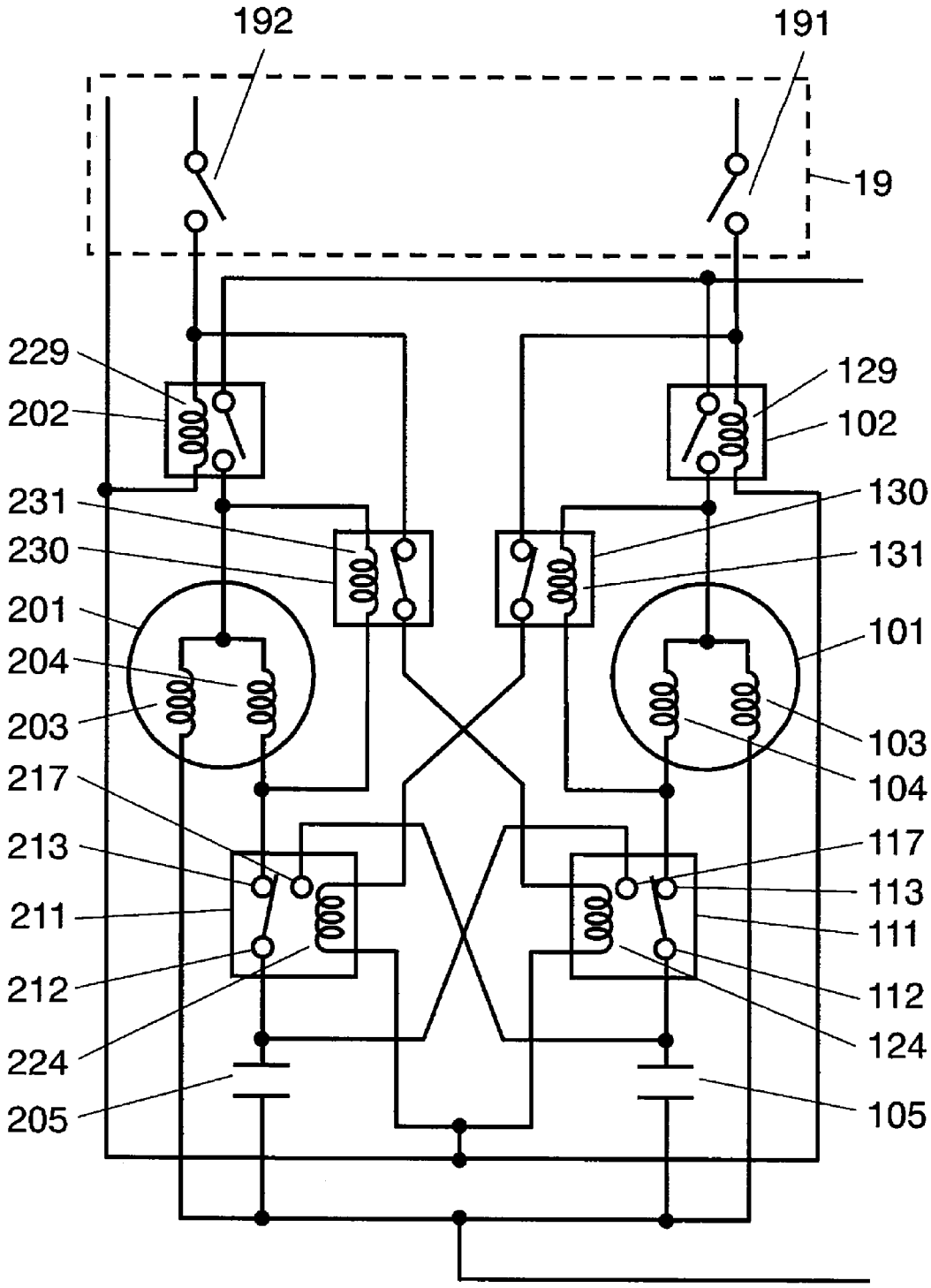
FIG. 2 is an electrical circuit diagram of an air conditioner according to a second embodiment of the present invention.

FIG. 2 is an electrical circuit diagram of an air conditioner according to a second embodiment of the present invention. The air conditioner includes two compressors: first compressor 101 and second compressor 201. The same components as those in the first embodiment are referred to with the same numerals and symbols as those in the first embodiment and may not described in detail again.

With reference to FIG. 2, the structure of the air conditioner according to the second embodiment of the present invention is described as follows.

Between auxiliary coil 104 of first compressor 101 and phase advance capacitor 105 (first phase advance capacitor) is provided switching relay 111 (first switching relay) which switches between two contacts. Common terminal 112 of switching relay 111 is connected to phase advance capacitor 105 for first compressor 101. Terminal 113, which is closed when the relay coil is not supplied with current, is connected to auxiliary coil 104 of first compressor 101. The other terminal 117, which is closed when the relay coil is supplied with current, is connected to the wiring that connects auxiliary coil 204 of second compressor 201 and phase advance capacitor 205. As a result, relay coil 124 for first compressor 101 is connected in parallel with coil 229 of power relay 202 (second power relay) for second compressor 201. Furthermore, cutout relay 230 (second cutout relay), which is open when auxiliary coil 204 of second compressor 201 is supplied with current, is connected to a conductive wire. The conductive wire connects relay coil 124 for first compressor 101 and coil 229 of power relay 202 for second compressor 201.

In the same manner, between auxiliary coil 204 of second compressor 201 and phase advance capacitor 205 (second phase advance capacitor) is provided switching relay 211 (second switching relay) which switches between two contacts. Common terminal 212 of switching relay 211 is connected to phase advance capacitor 205 for second compressor 201. Terminal 213, which is closed when the relay coil is not supplied with current, is connected to auxiliary coil 204. The other terminal 217, which is closed when the relay coil is supplied with current, is connected to the wiring that connects auxiliary coil 104 of first compressor 101 and phase advance capacitor 105. Relay coil 224 is connected in parallel with coil 129 of power relay 102 (first power relay) for first compressor 101. Furthermore, cutout relay 130 (first cutout relay), which is open when auxiliary coil 104 of first compressor 101 is supplied with current, is connected to a conductive wire. The conductive wire connects relay coil 224 and coil 129.

In the air conditioner of the present embodiment, when first compressor 101 is started, phase advance capacitor 205 for second compressor 201 can be temporarily connected in parallel with phase advance capacitor 105 for first compressor 101. On the contrary, when second compressor 201 is started, phase advance capacitor 105 for first compressor 101 can be temporarily connected in parallel with phase advance capacitor 205 for second compressor 201. This structure eliminates the need to provide a starting capacitor for either of first and second compressors 101 and 201 so as to increase the starting torque of each of first and second compressors 101 and 201, thereby making the system inexpensive.

The air conditioner having the aforementioned structure is described in more detail as follows.

First compressor 101 is connected to power relay 102, which connects or disconnects an AC power supply. First compressor 101 includes a motor having two coils: main coil 103 and auxiliary coil 104. Auxiliary coil 104 is connected to phase advance capacitor 105.

In the same manner, second compressor 201 is connected to power relay 202, which connects or disconnects the AC power supply. Second compressor 201 includes a motor having two coils: main coil 203 and auxiliary coil 204. Auxiliary coil 204 is connected to phase advance capacitor 205. First compressor 101 and second compressor 201 are connected in parallel with the AC power supply.

Between auxiliary coil 104 of first compressor 101 and phase advance capacitor 105 is provided switching relay 111 which switches between two contacts. Common terminal 112 of switching relay 111 is connected to phase advance capacitor 105. Terminal 113, which is closed when relay coil 124 of switching relay 111 is not supplied with current, is connected to auxiliary coil 104.

Second compressor 201 has the same structure as first compressor 101. Between auxiliary coil 204 of second compressor 201 and phase advance capacitor 205 is provided switching relay 211 which switches between two contacts. Common terminal 212 of switching relay 211 is connected to phase advance capacitor 205. Terminal 213, which is closed when relay coil 224 of switching relay 211 is not supplied with current, is connected to auxiliary coil 204.

The other terminal 117, which is closed when the relay coil of switching relay 111 is supplied with current, is connected the wiring between common terminal 212 of switching relay 211 and phase advance capacitor 205. The other terminal 217, which is closed when the relay coil of switching relay 211 is supplied with current, is connected to the wiring between common terminal 112 of switching relay 111 and phase advance capacitor 105. Relay coils 124 and 224 are both primary coils.

Primary coil 124 of switching relay 111 is connected in parallel with primary coil 229 of power relay 202 (second power relay) with cutout relay 230 interposed therebetween. The power supply to primary coil 124 is turned on or off by the operation of cutout relay 230. Primary coil 231 of cutout relay 230 is connected in parallel with auxiliary coil 204 of second compressor 201.

Primary coil 224 of switching relay 211 is connected in parallel with primary coil 129 of power relay 102 (first power relay) with cutout relay 130 interposed therebetween. The power supply to primary coil 224 is turned on of off by the operation of cutout relay 130. Primary coil 131 of cutout relay 130 is connected in parallel with auxiliary coil 104 of first compressor 101.

Controller 19 includes first compressor operation switch 191 and second compressor operation switch 192. First compressor operation switch 191 energizes primary coil 129 of power relay 102, and second compressor operation switch 192 energizes primary coil 229 of power relay 202.

First compressor 101 operates when first compressor operation switch 191 in controller 19 closes the contact of power relay 102. Before the motor in first compressor 101 starts to rotate, primary coil 131 of cutout relay 130 is not supplied with current, and therefore the contact of cutout relay 130 is in the closed state.

Then, when primary coil 224 of switching relay 211 is supplied with current, common terminal 212 of switching relay 211 is connected to terminal 217, which is closed when the relay coil is supplied with current. Consequently, phase advance capacitor 205 is separated from auxiliary coil 204 of second compressor 201 and connected to auxiliary coil 104 of first compressor 101 in parallel with phase advance capacitor 105.

The parallel connection of phase advance capacitors 105 and 205 results in an increase in the starting torque of first compressor 101, thereby facilitating the start-up of first compressor 101.

As soon as first compressor 101 is started, primary coil 131 of cutout relay 130 starts to be supplied with current. The terminal of cutout relay 130 for first compressor 101 is opened so as to interrupt the current supply to primary coil 224 of switching relay 211. Then, common terminal 212 of switching relay 211 is connected to terminal 213, which is closed when the relay coil is not supplied with current. As a result, phase advance capacitor 205 is again connected to auxiliary coil 204 of second compressor 201.

Through these operations, the capacity of phase advance capacitor 205 is added to the capacity of phase advance capacitor 105 when first compressor 101 is started. This increases the starting torque of first compressor 101, thereby facilitating the start-up of first compressor 101. In the case where first compressor 101 is started when second compressor 201 is in operation, phase advance capacitor 205 is temporarily separated from second compressor 201. However, second compressor 201 has only a slight decrease in torque during the operation, and therefore the temporary separation of phase advance capacitor 205 does not interrupt the operation.

On the contrary, when second compressor 201 is started, phase advance capacitor 105 is temporarily separated from first compressor 101 and connected to auxiliary coil 204 in parallel with phase advance capacitor 205. As a result, second compressor 201 has an increased starting torque.

Figure 3:
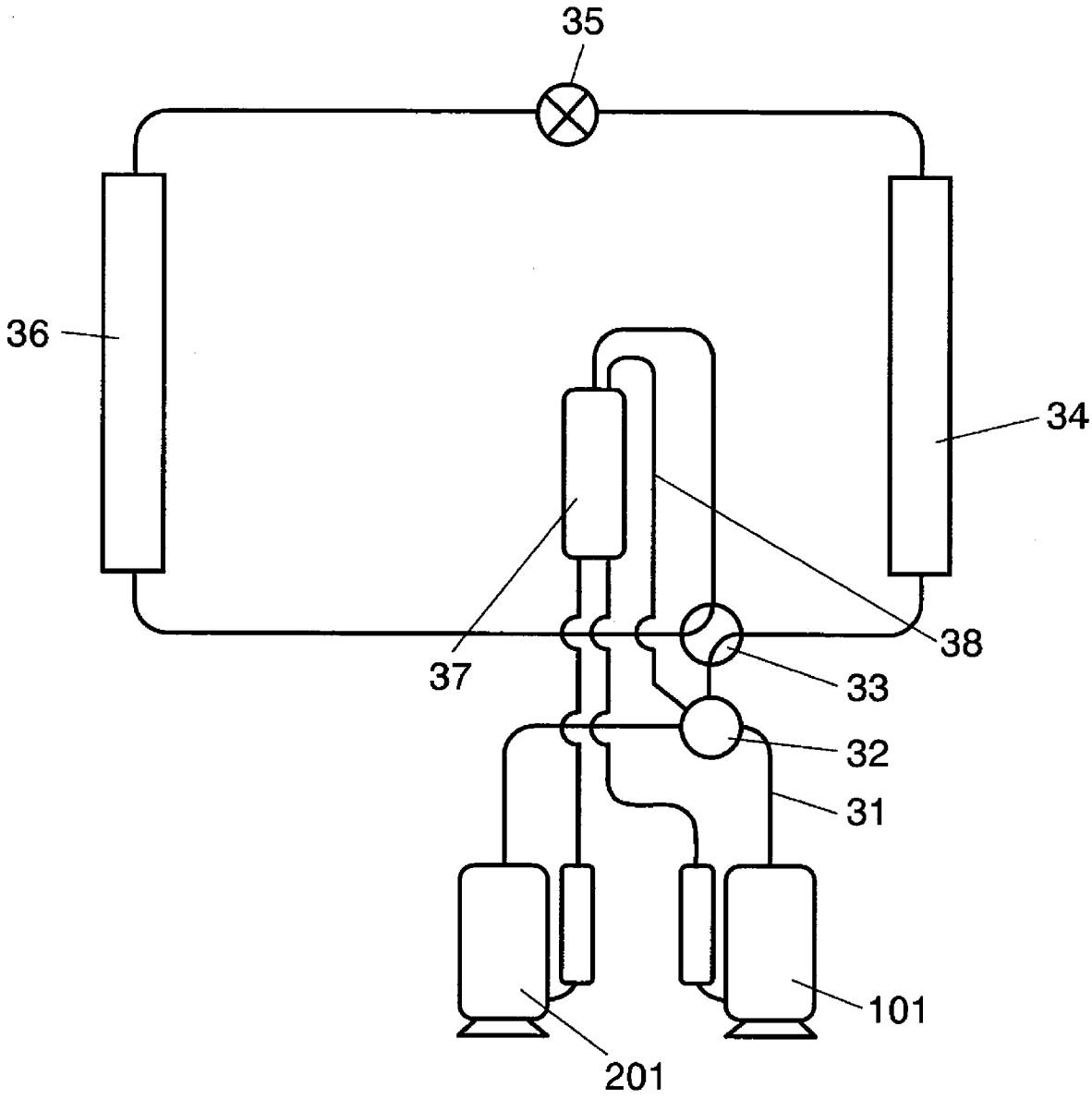
FIG. 3 is a block diagram showing the refrigeration cycle of the air conditioner according to the first or second embodiment of the present invention.
Figure 4:
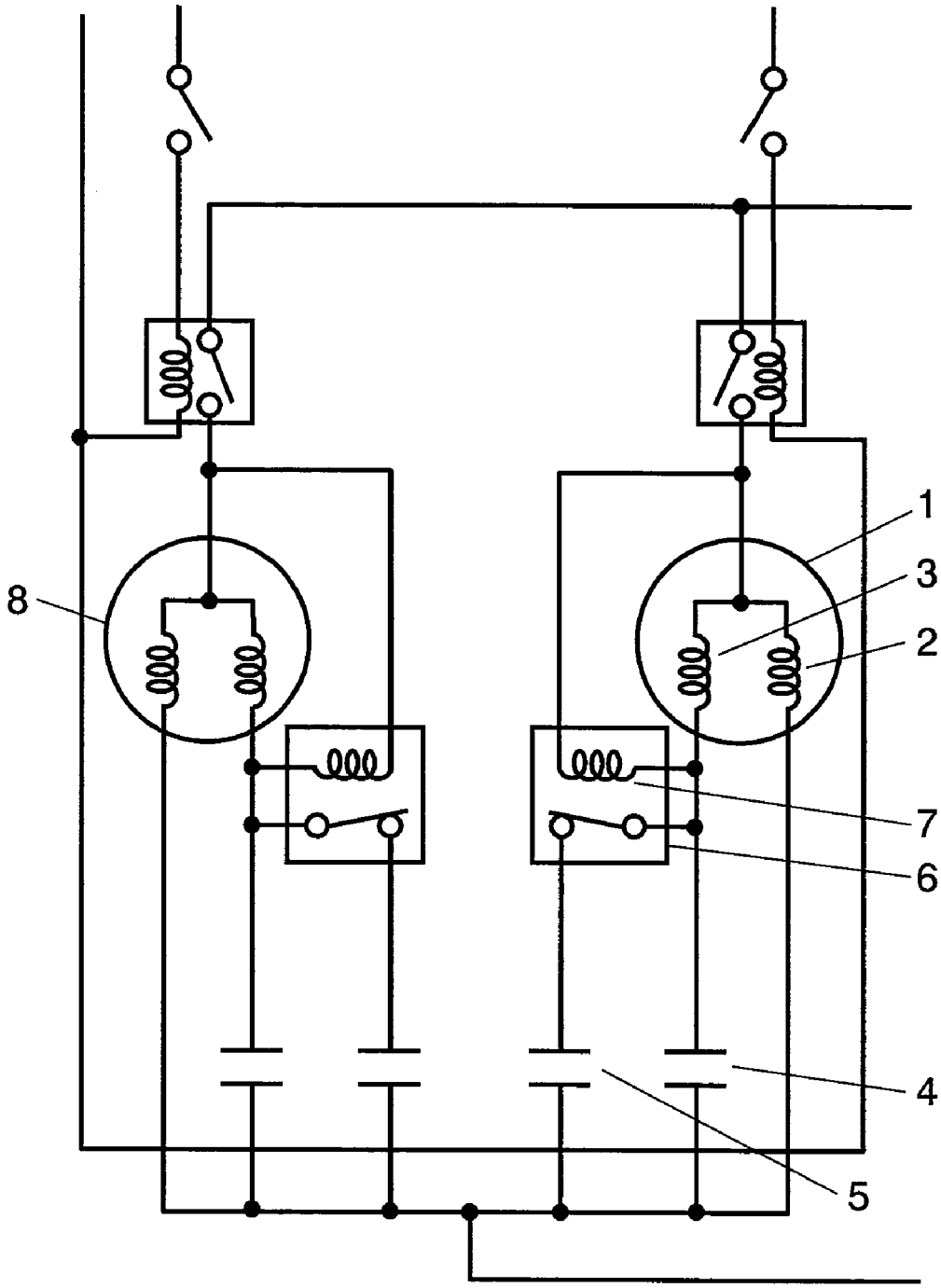
FIG. 4 is an electrical circuit diagram of a conventional air conditioner.

FIG. 3 is a block diagram showing the refrigeration cycle of the air conditioner according to the first or second embodiment of the present invention. In FIG. 3, cooling is on.

First and second compressors 101 and 201 compress a high-temperature, high-pressure gaseous refrigerant. The compressed refrigerant is led to oil separator 32 through refrigerant discharge pipes 31 and then to outdoor heat exchanger 34 via four-way valve 33. The high-temperature, high-pressure gaseous refrigerant is condensed into a medium-temperature, high-pressure liquid in outdoor heat exchanger 34. The refrigerant is then decompressed into a low-temperature, low-pressure condition in expansion valve 35 and led to indoor heat exchanger 36. The refrigerant then evaporates in indoor heat exchanger 36 by extracting heat from the indoor air. The resulting low-pressure gaseous refrigerant is led to liquid sump 37 via four-way valve 33. Then, the refrigerant returns to first and second compressors 101 and 201. Oil separator 32 separates lubricating oil, which is led to liquid sump 37 through oil return pipe 38.

Accordingly, the air conditioner according to the present invention having two compressors enables, when one compressor is started, the phase advance capacitor for the other compressor to be temporarily used in parallel with the phase advance capacitor for the one compressor. This structure increases the starting torque of each of the two compressors. Besides air conditioners, the present invention is applicable to the applied equipment of refrigeration cycle such as dehumidifiers and dryers.

What is claimed is:

1. An air conditioner comprising:

a controller;

a first compressor selectively electrically connected to a first phase advance capacitor responsive to a first control signal of the controller; and a second compressor selectively electrically connected to a second phase advance capacitor responsive to a second control signal of the controller, wherein the first phase advance capacitor is selectively electrically connected in parallel with the second phase advance capacitor responsive to at least one of the first control signal and second control signal of the controller, wherein a first switching relay is provided between the first compressor and the first phase advance capacitor; and a second switching relay is provided between the second compressor and the second phase advance capacitor, the first switching relay is connected to a place between the second compressor and the second phase advance capacitor;

the second switching relay is connected to a place between the first compressor and the first phase advance capacitor;

the first switching relay is connected to the first phase advance capacitor;

the second switching relay is connected to the second phase advance capacitor; and the first switching relay and the second switching relay are switched responsive to the first and second control signals of the controller respectively.

2. An air conditioner comprising:

a controller;

a first compressor selectively electrically connected to a first phase advance capacitor responsive to a first control signal of the controller; and a second compressor selectively electrically connected to a second phase advance capacitor responsive to a second control signal of the controller, wherein the first phase advance capacitor is selectively electrically connected in parallel with the second phase advance capacitor responsive to at least one of the first control signal and second control signal of the controller, wherein the first compressor and the second compressor each having a main coil and an auxiliary coil; and the air conditioner further comprises:

a first switching relay provided between the auxiliary coil of the first compressor and the first phase advance capacitor; and a second switching relay provided between the auxiliary coil of the second compressor and the second phase advance capacitor, the first and second switching relays each include a relay coil, a common terminal, a normally closed terminal and a normally open terminal;

the normally open terminal of the first switching relay is connected to a place between the auxiliary coil of the second compressor and the second phase advance capacitor;

the normally open terminal of the second switching relay is connected to a place between the auxiliary coil of the first compressor and the first phase advance capacitor;

the common terminal of the first switching relay is connected to the first phase advance capacitor;

the common terminal of the second switching relay is connected to the second phase advance capacitor; and the first switching relay and the second switching relay are responsive to the first and second control signals of the controller when one of the first compressor and the second compressor is started.

* * * * *